United States Patent [19]

Braber et al.

[11] 4,011,949

[45] Mar. 15, 1977

[54] PACKAGE CONSTRUCTION FOR OPENING ONLY BY A PREDETERMINED PROCEDURE

[75] Inventors: Robert J. Braber; Paul L. Weber, both of Harleysville, Pa.

[73] Assignee: The Lehigh Press, Inc., Harleysville, Pa.

[22] Filed: June 18, 1975

[21] Appl. No.: 588,067

[52] U.S. Cl. ..... 206/532; 206/484; 206/498; 206/538

[51] Int. Cl.[2] ..... B65D 83/04

[58] Field of Search ..... 206/528, 530, 529, 532, 206/534.1, 534.2, 538, 539, 498, 469, 484

[56] References Cited

UNITED STATES PATENTS

| | | | |
|---|---|---|---|
| 3,835,995 | 9/1974 | Haines | 206/498 |
| 3,872,970 | 3/1975 | Edison | 206/532 |
| 3,873,735 | 3/1975 | Chalin et al. | 206/498 |
| 3,894,896 | 7/1975 | Watanabe | 206/538 |
| 3,912,081 | 10/1975 | Haines et al. | 206/498 |
| 3,924,748 | 12/1975 | Braverman | 206/498 |

*Primary Examiner*—William Price
*Assistant Examiner*—Joseph M. Moy
*Attorney, Agent, or Firm*—Robert K. Youtie

[57] ABSTRACT

A package construction resistant to tampering including a pair of laminated layers, one layer having a pocket for receiving product and a cut-out spaced from the pocket, the other layer extending across both the pocket and cut-out, and a line of weakening for severing the layers to expose a finger-grip portion of said other layer peelably retained in position across said cut-out.

4 Claims, 4 Drawing Figures

PACKAGE CONSTRUCTION FOR OPENING ONLY BY A PREDETERMINED PROCEDURE

BACKGROUND OF THE INVENTION

As is well known, there are now laws and regulations requiring the packaging of dangerous products so as to avoid ready access by children while enabling more knowledgeable adults to obtain access to the product by following a predetermined procedure, say of instructions imprinted on the package or elsewhere, if desired. An example of a package of this general type is disclosed in U.S. Pat. No. 3,835,995. However, such prior art packages may be lacking in strength and toughness to resist repeated bending and other manipulation, and present openings subject to damaging entrance therein of little fingers and implements, as well as presenting loose components susceptible of accidental grasping and pulling.

SUMMARY OF THE INVENTION

It is, therefore, an important object of the present invention to provide a package construction of the type described which is of greater strength and durability without increased cost to more staunchly resist repeated manipulation as by bending, and is entirely adhesively secured or sealed to afford no openings for insertion of implements or fingers and present no loose elements capable of being grasped or pulled, and which otherwise overcomes the above-mentioned deficiencies in the prior art.

It is a further object of the present invention to provide a package construction having the advantageous characteristics mentioned in the preceding paragraph, which is simpler in structure and more economical in manufacture, and staunch, durable and reliable to effectively protect the contents, resist unauthorized tampering, and otherwise accomplish its intended objects.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

DESCRIPTION OF THE PREFERRED EMBODIMENT

Figure 1:
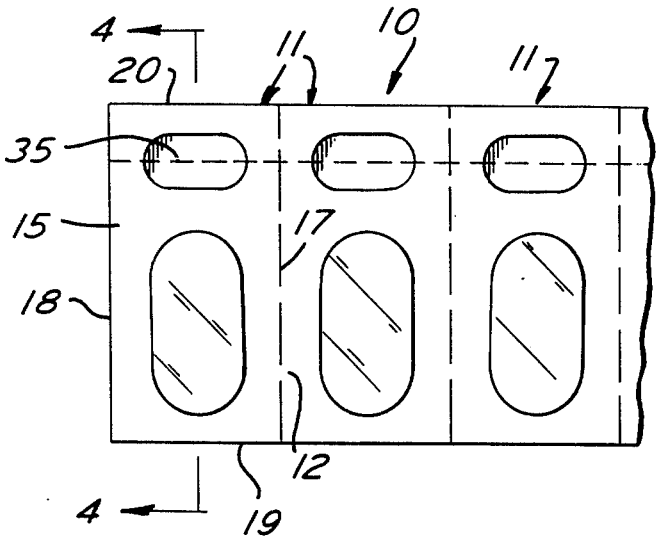
FIG. 1 is a plan view showing a strip of packages constructed in accordance with the teachings of the present invention.

Referring now more particularly to the drawings, and specifically to FIG. 1 thereof, there is illustrated therein a strip 10 of a plurality of detachably connected packages 11. The plurality of packages 11 may be fabricated in large sheets, if desired, and cut into strips 10, the packages of the strip being detachably secured together, as by severance lines, scores or tags 12, or otherwise, as desired.

Figure 2:
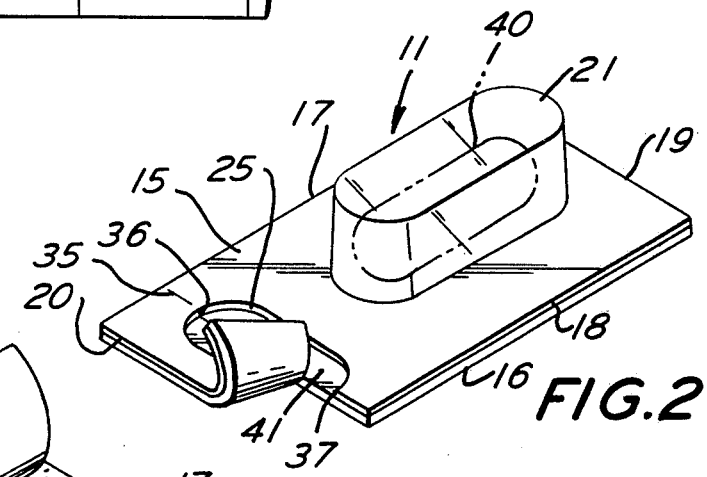
FIG. 2 is an enlarged perspective view showing one package of the strip of FIG. 1, apart from the strip, and illustrating an early stage in the predetermined opening procedure.
Figure 3:
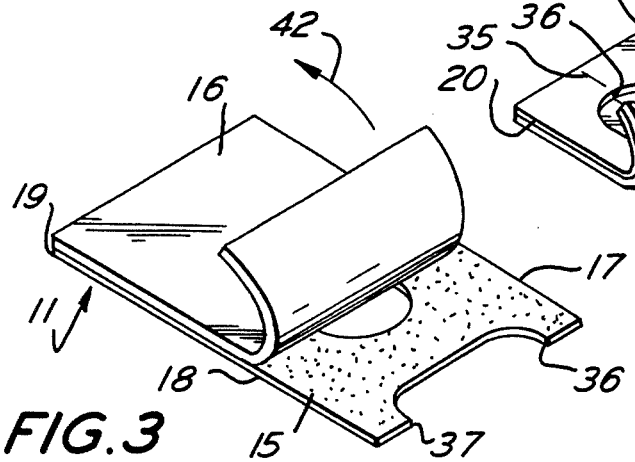
FIG. 3 is a perspective view showing the package of FIG. 2, from the underside and illustrating a later stage in the opening procedure.
Figure 4:
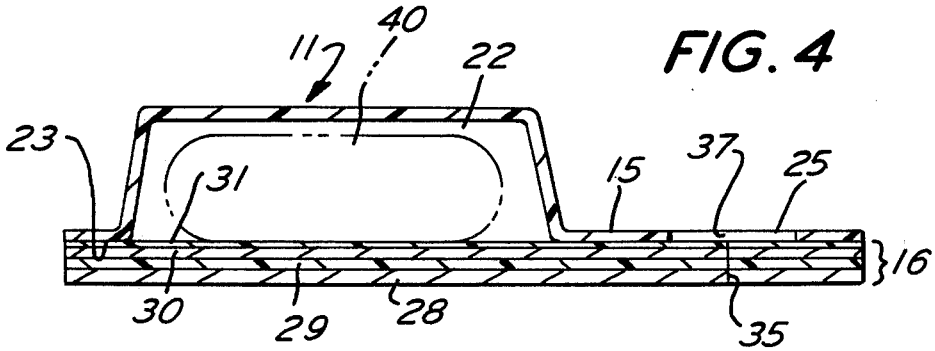
FIG. 4 is a transverse sectional view taken generally along the line 4—4 of FIG. 1, enlarged for clarity of detail.

An individual package 11 is shown in detail in FIGS. 2–4, and includes a relatively stiff carrier layer 15 which is secured in facing engagement or laminated to a relatively flexible closure layer 16. The closure layer 16 may, itself, be a multi-ply or layer laminate, as seen in FIG. 4 and will be described hereinafter in greater detail.

The carrier layer 15 may advantageously be fabricated of vinyl, of a thickness and rigidity to be generally self-sustaining, and adapted for die cutting and thermoforming. In the illustrated embodiment, the carrier layer 15 is generally of rectangular outline configuration, including a pair of laterally spaced, generally parallel side edges 17 and 18, and a pair of spaced, parallel end edges 19 and 20 extending generally normal to and between opposite ends of side edges 17 and 18.

The carrier layer 15 is generally flat or planar and formed at a location spaced within the edges 17–20 with a raised or embossed region 21 defining a blister or pocket. The blister or pocket 21 is offset upwardly, as seen in FIGS. 2 and 4, from the plane of carrier layer 25, defining therewithin a cavity of space 22 which opens downwardly or through the lower side or under surface 23 of the carrier layer.

In addition, the carrier layer or relatively stiff sheet 15 is formed at a location spaced from the upset blister or pocket 21, and also located entirely within the bounding layer edges 17–20, with a through cut-out, opening or hole 25. In the illustrated embodiment the blister or pocket 21 is elongate longitudinally of the package 11, and the cut-out or hole 25 is spaced from the blister longitudinally of the package, and of an ovaloid configuration extending transversely of the package. However, these arrangements and configurations may be otherwise, as circumstances require.

The relatively flexible closure layer 16 may be of an outline configuration generally rectangular and congruent to the outline configuration of carrier layer 15 and disposed in congruent facing engagement with the underside 23 of the carrier layer. Further, the closure layer 16 may be imperforate and impervious so as to extend across and on the underside of both the pocket 21 and cut-out 25 so as to close the same.

In particular, the closure layer 16 may include an outermost ply or laminate 28 of paper, say to carry copy as desired, a next adjacent ply or laminate 29 of plastic for toughness and adhesion, say of Mylar, a next inner ply or laminate of foil, say aluminum foil as at 30, for its barrier properties, and an innermost ply or laminate 31, say a foil coating of vinyl for peelable heat-sealability of the carrier and closure layers.

Thus, the carrier layer 15 and closure layer 16 are releasably adhesively secured together by heat-sealing throughout the entire extent of their facing engagement, so that the carrier layer is peelably adhesively secured to the closure layer entirely about the pocket 21 and circumferentially entirely about the cut-out 25 to and entirely along the bounding carrier layer edges 17, 18, 19 and 20. By this heat-sealed securement, particularly of the carrier layer 15 entirely about the bounding edge of cut-out 25 to the closure layer 16, the package is of enhanced strength and toughness, more resistant to repeated manipulation and bending, and totally closed to present no openings for the insertion of an implement or fingers, and entirely absent any loose elements or flaps capable of being grasped or pulled.

In addition, the package as thus far described is formed with a line of weakening or severance, as at 35, formed in both the carrier layer 15 and closure layer 16, and extending between opposed locations of spaced edges 17 and 18. Further, the weakened portion of severance line 35 extends along cut-out 25, and may extend across the cut-out or hole 25 between spaced bounding edge regions of the hole, as at 36 and 37.

The predetermined procedure for gaining access to a pill 40, or other contents of the pocket 21, first requires removal of an individual package 11 from the strip 10 in the conventional manner, as by flexure along a side edge and tearing of tags 12. It is then necessary to deliberately tear the laminated layers 15 and 16 along the severance line 35, preferably preliminarily flexing the carrier and closure layers 15 and 16 along the severance line to facilitate subsequent tearing and separation of parts on opposite sides of the severance line. This tearing procedure is best seen in FIG. 2.

Upon tearing along severance line 35, there remains exposed a portion 41, see FIG. 2, of closure layer 16 extending between spaced edge locations 36 and 37 of cut-out 25 and retained in position relative to the carrier layer by adhesive securement to the carrier layer at the spaced edge locations 36 and 37. Hence, there is available no loose element or flap capable of accidental or easy grasping and pulling. However, the retained and exposed closure layer portion 41 is, by deliberate knowledgeable intent, manually graspable for peeling separation of the closure layer 16 from the carrier layer 15, as in the direction of arrow 42 in FIG. 3. Continued peeling action will, of course, entirely remove and separate the closure layer 16 from the carrier layer 15 and entirely open the underside of pocket or blister 21 for access to and removal therefrom of the contents 40.

From the foregoing it is seen that the present invention provides a package construction requiring exercise of a predetermined opening procedure to effectively bar access to children, and which otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A package construction for opening only by a predetermined process comprising a generally flat carrier layer having a through cut-out located in spaced relation within the boundary of the carrier layer to define a hole, a blister formation on said carrier layer spaced from said cut-out and opening to one side of said carrier layer, and a relatively flexible closure layer on said one side of and in facing engagement with said carrier layer extending across and in closing relation with both said blister and cut-out, said carrier and closure layers being releasably adhesively secured together throughout the entire extent of their facing engagement for maximum strength and resistance to blister opening except by the predetermined procedure, and a weakened severance line formed in said carrier and closure layers extending between spaced edge locations of said layers and generally chordally across said cut-out, for deliberate manual separation along said severance line to expose for intentional grasping only a closure layer portion retained with a straight severance edge relatively taut in position extending across said cut-out between spaced bounding edge regions of said hole.

2. A package construction according to claim 1, said severance line being defined by a row of scores formed in both said layers.

3. A package construction according to claim 1, said adhesive securement of said layers being defined by a peelable heat seal over the entire extent of the facing engagement between said carrier and closure layers.

4. A package construction according to claim 3, said closure layer including a heat-sealable coating over its entire surface toward said carrier layer, said coating being heat-sealed to the entire carrier layer except said blister and cut-out.

* * * * *